US005241289A

United States Patent [19]

Markowski et al.

[11] Patent Number: 5,241,289

[45] Date of Patent: Aug. 31, 1993

[54] EXHAUST ARC GAS MANIFOLD

[75] Inventors: Robert G. Markowski, East Haven; James R. Pratt, Wolcott; Dean A. Robarge, New Britain, all of Conn.

[73] Assignee: General Electric Company, New York, N.Y.

[21] Appl. No.: 918,091

[22] Filed: Jul. 24, 1992

[51] Int. Cl.[5] ..... H01H 9/30

[52] U.S. Cl. ..... 335/201; 335/202

[58] Field of Search ..... 335/201, 202; 200/144 R, 304, 305, 306, 149 R, 149 A

[56] References Cited

U.S. PATENT DOCUMENTS 4,181,836 1/1980 Miracle .

4,963,849 10/1990 Kowalczyk et al. ..... 335/201

*Primary Examiner*—Lincoln Donovan

*Attorney, Agent, or Firm*—Richard A. Menelly

[57] ABSTRACT

An industrial rated molded case circuit breaker fitted with an exhaust arc gas manifold arranged over ventilation slots of the circuit breaker and disposed at a line end thereof to redirect the arc exhaust gases exiting the ventilation slots. The exhaust arc gas manifold is fixedly attached to the circuit breaker to prevent an electric fault from occurring between the different phases of a multi-phase electric power distribution system connected to the line end of the circuit breaker. An electric fault is further prevented between the exiting arc gases and the line terminals attached to the circuit breaker thereof.

15 Claims, 3 Drawing Sheets

EXHAUST ARC GAS MANIFOLD

BACKGROUND OF THE INVENTION

A conventional multiphase circuit breaker generates ionized gases within each phase of the circuit breaker during the circuit interrupt condition. Modern circuit breaker designs are more compact and generate additional power in smaller spaces than conventional circuit breakers. Due to the reduction of internal space and higher current levels, the gases produced when opening the circuit in question are more intense and at higher temperatures. When a compact current limiting circuit breaker, such as that described in U.S. Pat. No. 4,963,849 entitled "Compact Current Limiting Circuit Breakers" is used within an industrial power distribution circuit, intense arc gases are generated during overcurrent circuit interruption. These high temperature gases must exit the circuit breaker enclosure in order to prevent the circuit breaker enclosure from becoming over-stressed. Ventilated circuit breakers provide openings within the circuit breaker enclosure to allow the ionized gases to exit the circuit breaker in a controlled manner.

The U.S. patent application Ser. No. 07/736,673, filed Jul. 26, 1991, entitled "Molded Case Circuit Breaker Arc Exhaust Gas Controller" describes one means for controlling the egress of gases from the circuit breaker enclosure. The arc gases exiting through the ventilation slot of one line terminal compartment must be prevented from contacting a line terminal connector within an adjacent line terminal compartment to prevent a so-called "phase-to-phase" fault. The typical approach to prevent the occurrence of short circuits between the line end conductors of different phases is to each conductor with insulating tape. This practice is labor intensive and expensive.

The U.S. patent application Ser. No. 07/836,573, filed Feb. 18, 1992 , entitled "Arc-Proof Molded Case Circuit Breaker" describes one means of decreasing the intensity of the exiting arc exhaust gases so that the connecting busbars need not be separately shielded.

Another means is described in U.S. Pat. No. 4,181,836, wherein the exhaust openings of the circuit breakers are enclosed in a boot and the arc gases exiting the different phases of a circuit breaker remain therein. However, the boot does not provide separation of the gases from the different phases, it merely shields the metal enclosure in which the circuit breaker is mounted from being contacted by the arc gases. The boot merely provides additional space for the gases to expand to relieve the pressure therein.

Thus, the aforementioned solution has limited utility in circuit breakers that have higher interruption circuit levels. These solutions do not afford sufficient protection from the short circuit in higher interruption circuit level circuit breakers, because these types of circuit breakers generate greater amounts of energy and the gases become trapped within the boot without sufficient time to clear.

U.S. patent application Ser. No. 07/611,203 entitled "Bus Cover and Lug Cover for a Molded Case Circuit Breaker" describes a cover utilized in a double-branch configuration of circuit breakers and is a permanent fixture thereupon.

U.S. patent application Ser. No. 872,195 entitled "Circuit Breaker Phase Current Barrier" describes a phase barrier that is disposed at the line end of a circuit breaker to redirect the arc exhaust gases exiting from the circuit breaker. The phase barrier described therein can be utilized with a bus-plug type of system.

One purpose of the present invention is to provide protection from short circuits for higher level interruption circuit breakers during the interrupt condition.

Another purpose of the present invention is to provide protection that can be field installed as an add-on feature to any type of circuit breaker.

SUMMARY OF THE INVENTION

An exhaust arc gas manifold consists of an integrally molded body that forms three sections. The manifold is fitted over a line end of multiphase circuit breaker so that each section of the manifold is arranged over a ventilation slot of the circuit breaker. As exhaust arc gases are vented from each phase of the circuit breaker through the ventilation slots, the manifold redirects those arc gases to prevent short circuit conditions between arc gases if different phases and also between the arc gases and the conductors disposed at the end of the circuit breaker.

DESCRIPTION OF THE PREFERRED EMBODIMENT

Figure 1:
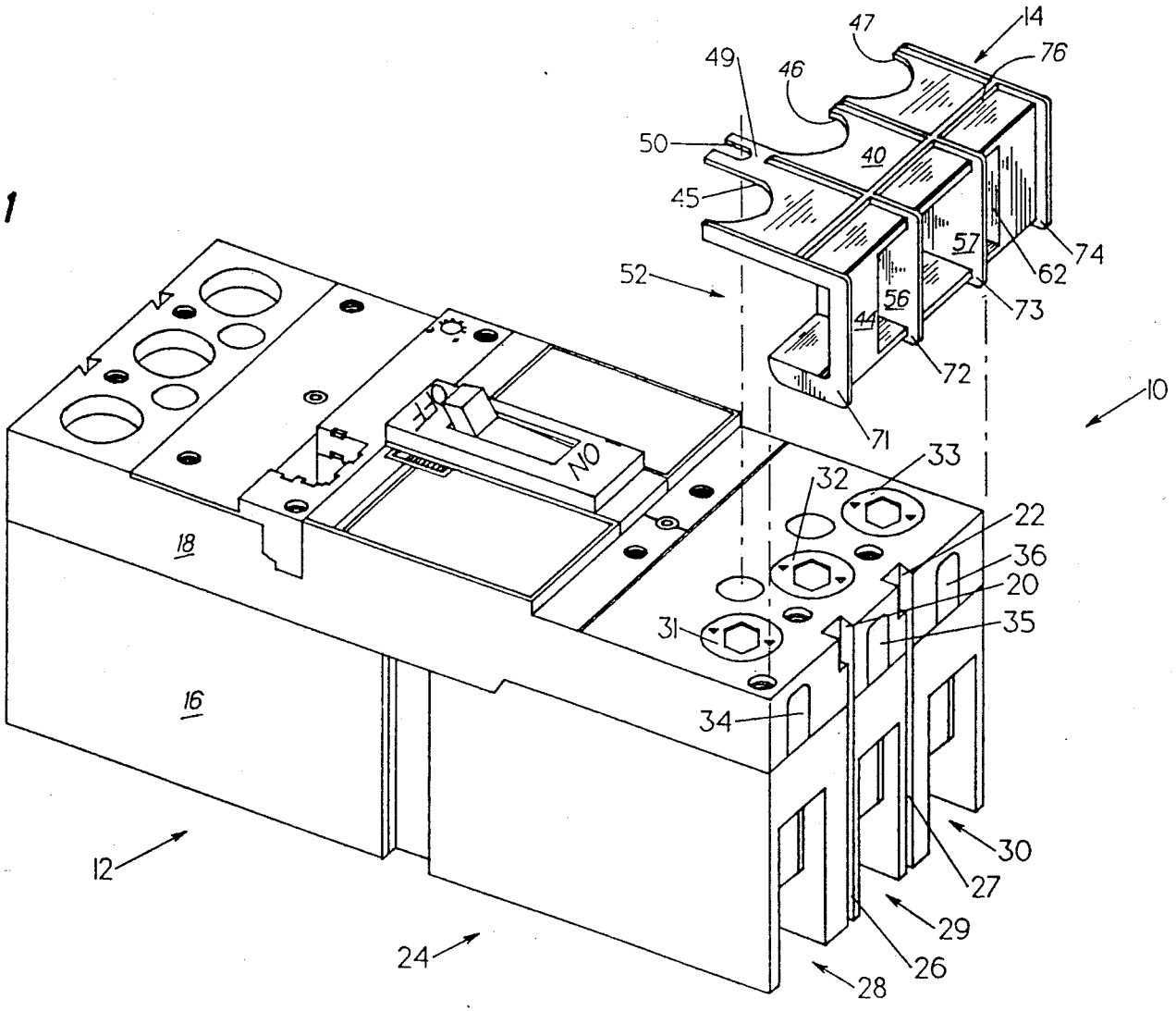
FIG. 1 is an exploded top perspective view of a circuit breaker with an exhaust arc gas manifold, in accordance with the invention.

FIG. 1 depicts a subassembly 10, including an industrial rated multiphase circuit breaker 12 and an exhaust arc manifold 14, to be arranged over the circuit breaker. The circuit breaker 12 consists of a molded plastic case 16 and molded plastic cover 18. The circuit breaker 12 further includes dovetail notches 20,22 disposed within the cover 18 at a line end 24 of the circuit breaker 12 and elongated slots 26,27 formed within the cover 18 and extending downward from the dovetail notches 20,22 through the case 16. The dovetail notches and elongated slots are positioned between phases 28–30 of the circuit breaker. Line connection plugs 31–33 are disposed on a top surface of the cover 18 to allow access to terminal screws. Ventilation slots 34–36 are formed at each phase 28–30 of the circuit breaker to vent ionized gases generated from within each phase during circuit breaker interrupt conditions.

Figure 2:
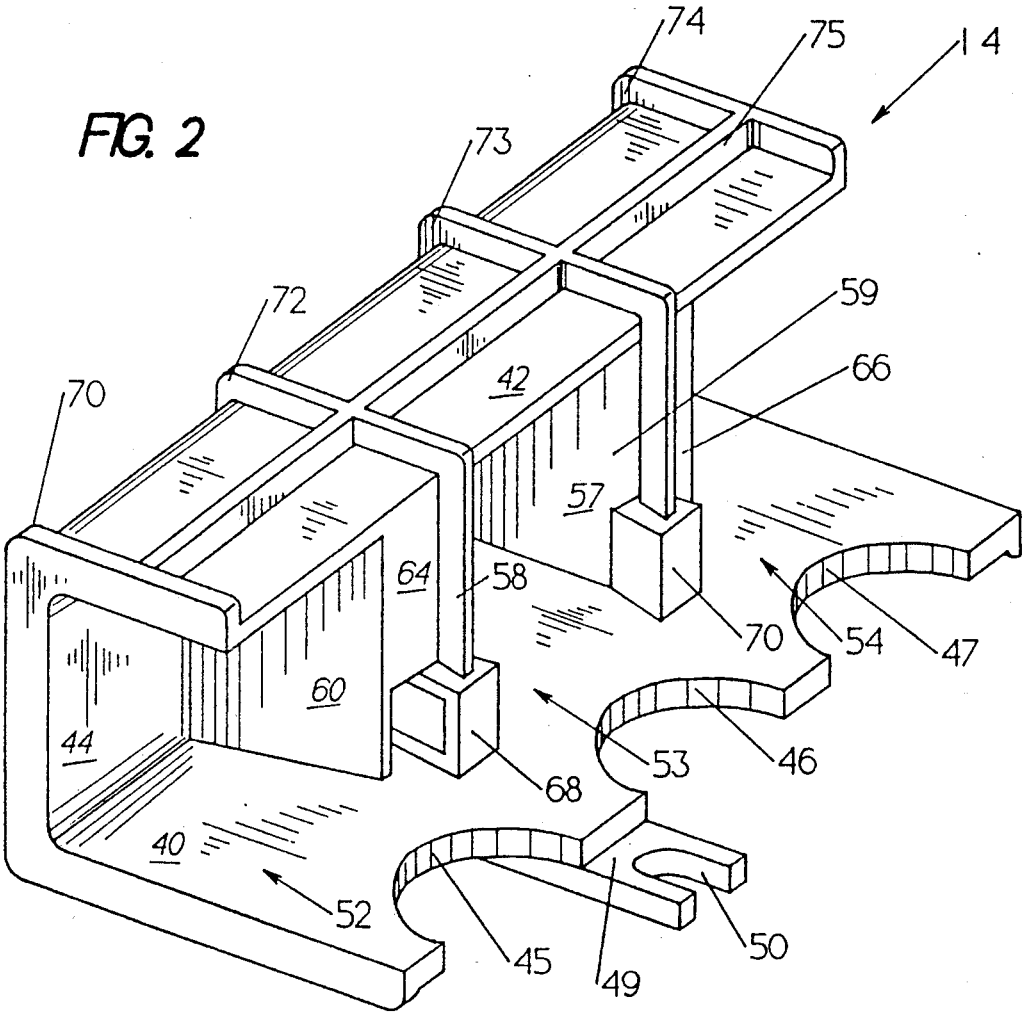
FIG. 2 is an upside down perspective view of the exhaust arc gas manifold of FIG. 1.
Figure 3:
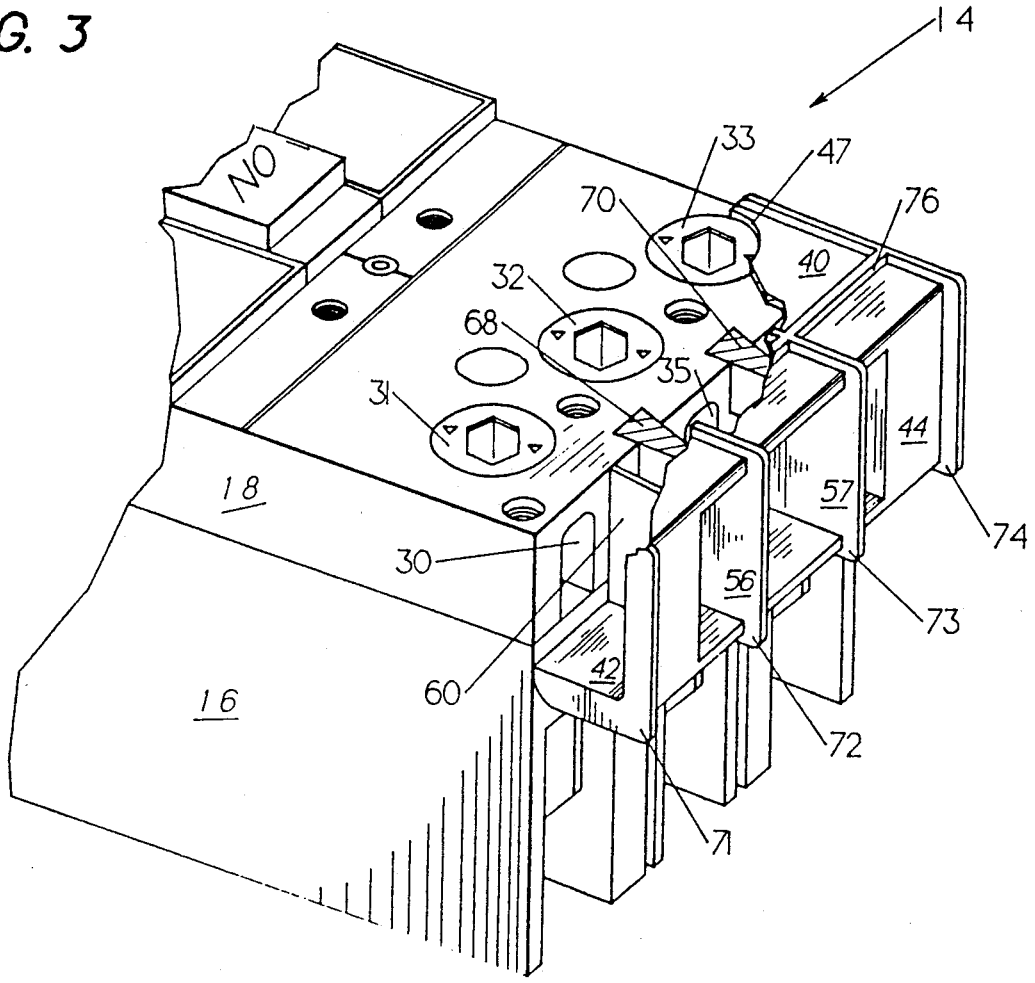
FIG. 3 is a top perspective cut-away view of the circuit breaker and the exhaust arc gas manifold of FIG. 1.

Referring now to FIG. 2, the manifold 14 comprises an integrally molded one piece body having a substantial C-shape that is formed by an upper wall 40, a lower wall 42, and a bottom wall 44 extending between the upper and lower walls, wherein the open end of the upper wall 40 extends further outward than that of the lower wall 42. The upper wall 40 includes radial notches 45–47 disposed on the open end thereof to allow access to the corresponding line connection plugs 31–33 of the circuit breaker, as shown in FIG. 3. The upper wall 40 also includes a protruding arm 49 disposed between two of the radial notches 45,46 and having a radial slot 50 at the end thereof. The manifold 14 is subdivided into three sections, two outer 52,54 and one central 53, by means of two partition walls 56,57.

Each section 52–54 corresponds to each phase 28–30 of the circuit breaker. The partition walls extend between the upper and lower walls, so that the three sections are wholly isolated from one another. The partition walls extend further outward than the lower wall, forming a flange 58,59. The bottom wall 44 connects the upper and lower walls in the outer sections 52,54 and produces an opening in the center section 53 to allow the exhaust arc gases to vent.

The outer sections 52,54 include a tapered wall 60,62 adjacent to the partition walls 56,57 and a web 64,66 connecting the tapered walls 60,62 to the respective partition walls 56,57. The web is perpendicular to the partition wall and forms an obtuse angle with the tapered wall. The tapered wall extends between the upper and lower walls of the manifold and connects with the bottom wall. The web and the partition wall are notched out at the connection with the upper wall to accommodate a dovetail 68,70. The dovetails protrude past the partition walls and rest on the upper wall which also protrudes past the partition wall and still further than the dovetails.

Stiffening ribs 71–74 disposed on the outside of the C-shaped manifold follow the general shape thereof and provide additional strength thereto. Perpendicular strengthening ribs 75,76 disposed on the upper and lower walls of the manifold extend substantially across the lower walls of the manifold. The manifold is formed from a molded thermoplastic material.

In operation, as shown in FIGS. 1 and 3, the manifold is oriented so that the upper wall is in the upper position and the flanges 58,59 of the partition walls engage the dovetail notches 20,22 of the circuit breaker and slide further down into the notches 26,27 of the circuit breaker. The manifold dovetails 68,70 engage the circuit breaker dovetail notches 20,22, forming a dovetail joint, and fixedly securing the manifold to the circuit breaker so that the force of the gases exiting the circuit breaker does not pull the manifold away. Dovetail joints provide a locking mechanism sufficient to withstand the force of the outpouring exhaust gases.

As the dovetail joints are formed, the upper wall rests on the circuit breaker cover. The radial slot 50 formed within the arm 49 can be used to fasten the manifold to the circuit breaker by means of screws. As gases exit the circuit breaker through the ventilation slots 34–36, the manifold redirects the gases in such a way that the center phase 35 gases enter the center section 53 of the manifold an exit straight through. The gases exiting from the outer phases 34,36 enter the outer section of the manifold and are diverted at a substantially 90 degree angle and exit through the side openings of the manifold, thereby avoiding intermixing with gases in the other sections and contacting line terminal conductors, until the gases are cooled and de-ionized, thus causing effective redirection of exhaust gases.

Having thus described out invention, what we claim as new and desire to secure by Letters Patent is:

1. An exhausting gas manifold for molded case circuit breakers comprising:

an electrically-insulated body having an upper and lower wall joined by a bottom wall;

a pair of electrically-insulated walls perpendicular said bottom wall and extending between said upper and lower walls to thereby define a first section closed at a top, bottom, back and one side thereof;

a second section closed at a top, bottom and both sides thereof;

a third section closed at a top, bottom, back and one side thereof; and means formed within said upper wall attaching said body to one end of an industrial-rated circuit breaker.

2. The gas manifold of claim 1 wherein said upper wall, lower wall and bottom wall are integrally-formed in a single unit.

3. The gas manifold of claim 1 wherein said electrically-insulated base comprises plastic.

4. The gas manifold of claim 1 wherein said upper wall includes radial slots allowing access to circuit breaker terminal lugs when said manifold is attached to one end of an industrial-rated circuit breaker.

5. The gas manifold of claim 1 including means formed on a bottom surface of said upper wall adapted for being received in slots formed in a circuit breaker cover to hold said manifold against one end of an industrial rated circuit breaker.

6. The gas manifold of claim 5 wherein said means comprises a pair of dovetail extensions.

7. The gas manifold of claim 1 including an arm extending from said upper wall, said arm having means formed at one end for receiving a threaded fastener to secure said manifold to an industrial-rated circuit breaker.

8. A molded case circuit breaker having increased circuit interruption capacity comprising, in combination:

a plastic case and cover securely fastened together to form a circuit breaker enclosure, said cover including exhaust ports situated at one end of said enclosure;

a pair of linear extensions formed on said one end, each of said extensions having a linear slot defined within an outer edge of said extensions; and an external unitary gas manifold attached to said one end, said manifold comprising an upper wall, a lower wall and a bottom wall, said upper wall including a pair of dovetail extensions formed on a bottom surface, each of said extensions being retained within each of said linear slots for attaching said manifold external to said circuit breaker enclosure.

9. A molded case circuit breaker having increased circuit interruption capacity comprising, in combination:

a plastic case and cover securely fastened together to form a circuit breaker enclosure, said cover including exhaust ports situated at one end of said enclosure;

a pair of linear extensions formed on said one end, each of said extensions having a linear slot defined within an outer edge of said extensions;

a unitary gas manifold attached to said one end, said manifold comprising an upper wall, a lower wall and a bottom wall, said upper wall including a pair of dovetail extensions formed on a bottom surface, each of said extensions being retained within each of said linear slots for attaching said manifold to said circuit breaker enclosure, said manifold comprising an electrically-insulated body having an upper and lower wall joined by a bottom wall;

a pair of electrically-insulated walls perpendicular said bottom wall and extending between said upper and lower walls to thereby define a first section closed at a top, bottom, back and one side thereof;

a second section closed at a top, bottom and both sides thereof; and a third section closed at a top, bottom, back and one side thereof.

10. The molded case circuit breaker of claim 9 including a plurality of circuit breaker lug terminal slots formed within said circuit breaker cover and said manifold includes corresponding radial slots formed on said upper wall, whereby said radial slots provide access to said lug terminal slots when said manifold is attached to said circuit breaker.

11. The molded case circuit breaker of claim 10 including an arm extending from said upper wall, said arm overlapping said circuit breaker cover when said manifold is attached to said circuit breaker.

12. The molded case circuit breaker of claim 11 including a slot formed in one end of said arm, said slot receiving a fastener to secure said manifold to said circuit breaker.

13. The molded case circuit breaker of claim 1 wherein said first section receives arc gases emanating from one phase of said circuit breaker and directs said gases to one side of said circuit breaker enclosure.

14. The molded case circuit breaker of claim 13 wherein said second section receives gases emanating from another phase of said circuit breaker and directs said gases in a direction away from said one side.

15. The molded case circuit breaker of claim 13 wherein said third section receives gases from still another phase of said circuit breaker and directs said gases to an opposite side of said circuit breaker enclosure.

* * * * *